US005289158A

United States Patent [19]

Neves

[11] Patent Number: 5,289,158

[45] Date of Patent: Feb. 22, 1994

[54] RANGE MONITORING APPARATUS

[76] Inventor: James E. Neves, P.O. Box 595, Black Mountain, N.C. 28711

[21] Appl. No.: 858,612

[22] Filed: Mar. 27, 1992

[51] Int. Cl.[5] ..... G08B 1/00; G08B 21/00

[52] U.S. Cl. ..... 340/309.15; 340/310 CP; 340/500; 340/501; 340/635; 340/660; 340/664; 340/693; 307/131; 219/492

[58] Field of Search ..... 340/309.15, 310 CP, 340/500, 501, 635, 660, 663, 664, 693, 640, 656, 661, 662, 654; 361/86, 87; 307/130, 131, 139-141; 219/492

[56] References Cited

U.S. PATENT DOCUMENTS 3,763,488 10/1973 Klasing ..... 340/309.15
3,988,727 10/1976 Scott ..... 340/309.15
4,062,007 12/1977 Scott ..... 340/309.15
4,255,669 3/1981 Naugle ..... 340/664
5,046,157 9/1991 Smith et al. ..... 340/309.15

*Primary Examiner*—Donnie L. Crosland
*Attorney, Agent, or Firm*—Hardaway Law Firm

[57] ABSTRACT

An apparatus for combination with a standard range having burners thereon and a power line connected thereto is provided and senses the current through the power line for a pre-set level, times the current once the pre-set level is reached, interrupts the current, signals when interruption of the current has occurred and includes controls for controlling the timing and the signalling in the apparatus.

8 Claims, 7 Drawing Sheets

RANGE MONITORING APPARATUS

BACKGROUND OF THE INVENTION

This invention relates generally to the art of timers, and more particularly to timers for combination with the circuitry of a range.

The use of timers in the prior art is well known. Various devices exist within such prior art which relate generally to the usage of timers in range circuitry. Such devices play an important role in preventing accidents as they can indicate when it is time to turn a range off. It is fairly common for burners on a range to be innocently left on. It is also common for some ranges to have a built-in timer for timing while using the range. These timers may alert a user when a burner on the range should be turned off, however, the user himself still must turn the burner off. Should the user then turn off the timer and forget to turn off the burner, a hazard is thereby inadvertently created.

While the prior art devices perform well for their intended purposes, room for improvement exists within the prior art.

SUMMARY OF THE INVENTION

It is thus an object of this invention to provide a novel apparatus for monitoring a range.

It is a further object of this invention to provide such a novel apparatus for monitoring a range which automatically disconnects power to the range if the range is left on for a predetermined amount of time at a predetermined power level.

It is still a further object of this invention to provide such a novel apparatus for monitoring a range which disconnects power to the range if smoke or a predetermined temperature is detected.

It is yet still a further object of this invention to provide such a novel apparatus for monitoring a range which signals to indicate when power to the range has been disconnected.

These as well as other objects are accomplished by an apparatus in combination with a standard range having burners thereon and a power line connected thereto comprising sensing means for sensing the current through the power line, timing means for timing the current, disconnect means for interrupting the current, signaling means for providing a signal when the current has been disconnected, acknowledging means for providing a reset signal for continued operation after a timed power interruption occurs, and electronic control means for controlling the timing means and the signaling means. The apparatus may also include means for detecting high temperature and smoke within the range.

Other objects and a fuller understanding of the invention will become apparent from the following description given with reference to the various figures of drawings.

BRIEF DESCRIPTION OF THE DRAWINGS

FIG. 2' of the drawings is an enlarged view of the current sensing means.

DETAILED DESCRIPTION

In accordance with this invention it has been found that a novel apparatus for monitoring a range can be provided. This novel apparatus monitors the amount of time that current flows through a power line to a range and disconnects the current flow through the power line to the range if it reaches a predetermined level for a predetermined time. A signal is provided to indicate that disconnection of the power has occurred. The range monitoring apparatus of this invention also includes electronics for controlling the time interval and the alert signal.

Figure 1:
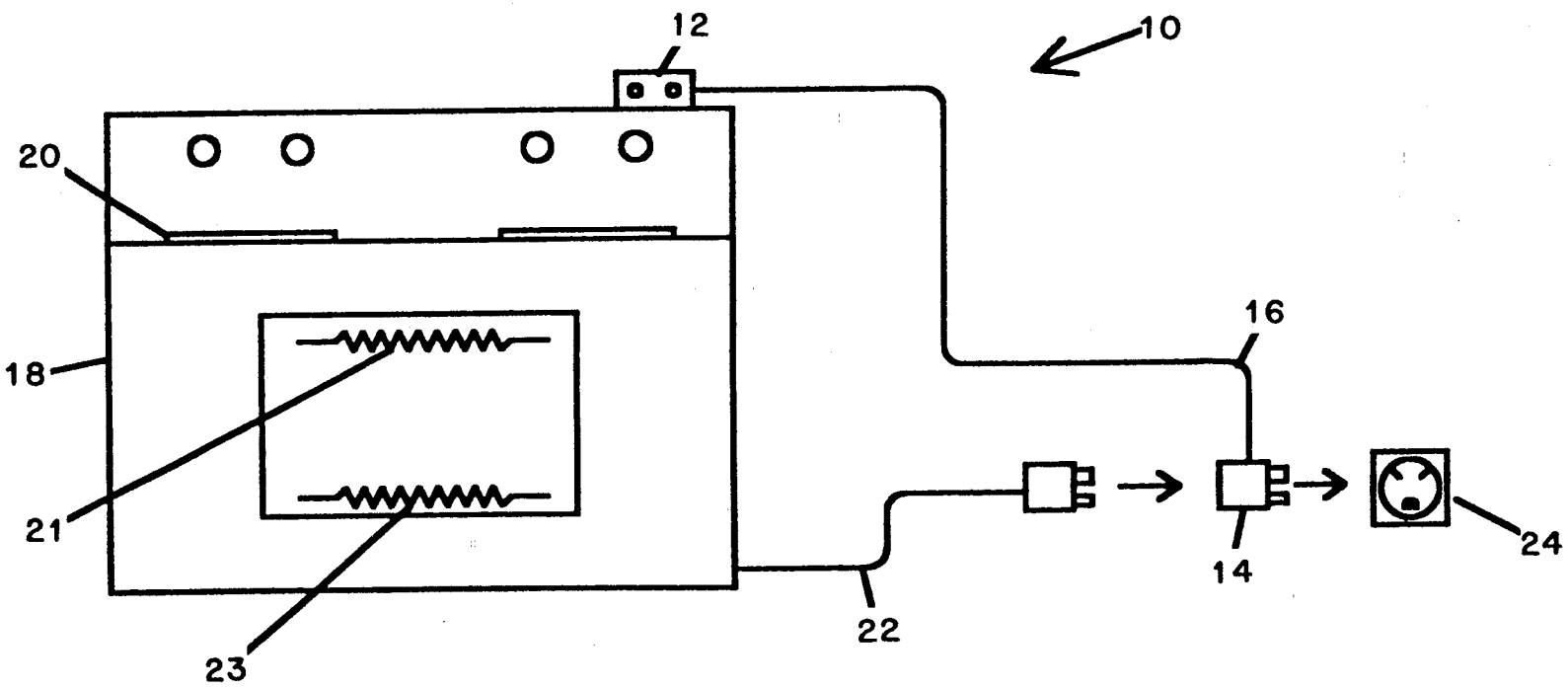
FIG. 1 of the drawings is a perspective view of the range monitoring apparatus according to this invention.

As illustrated in FIG. 1, in the preferred embodiment, the range monitoring apparatus 10 comprises two separate housing, display and control box 12 and sensing and control box 14 respectively, which are in electrical communication with each other as shown by wiring 16. Range monitoring apparatus 10 is intended to be used with a standard range 18 having burners 20 thereon, oven elements 21 and 23 therein and a power line 22 extending from range 18. Oven element 21 is typically a broiler element, and oven element 23 is typically a baking element.

Range monitoring apparatus 10 comprises sensing means for sensing the level of current flow through power line 22, timing means for timing the current through power line 22, and disconnect means for interrupting the current through power line 22. In the preferred embodiment shown in FIG. 1, the sensing means, the timing means, and the disconnect means are located in sensing box 14. Sensing box 14 can be plugged directly into an electrical receptacle 24. Power line 22 of range 18 can be plugged directly into sensing and control box 14. In this manner installation of sensing and control box 14 is easily and simply accomplished.

Sensing and control box 14 is in electrical communication with display and control box 12 in the preferred embodiment. Display and control box 12 contains a signaling means and electronic control means. The signaling means is activated by the disconnect means and provides a signal when the disconnect means interrupts current in power line 22. Sensing and control box 14 provides for the current interrupt to assume a non-interrupt (reset) state. In the preferred embodiment, the signaling means comprises an alarm and lamp (FIG. 4, V1 and A1). Also in the preferred embodiment, display and control box 12 includes a reset button PBI (FIG. 4) to allow power to be restored to range 18 and an override toggle SI (FIG. 3) for use when more cooking time is required than the predetermined amount of time set for the timing means. Display and control box 12 ideally is small and includes a magnet to hold it onto range 18.

Figure 2:
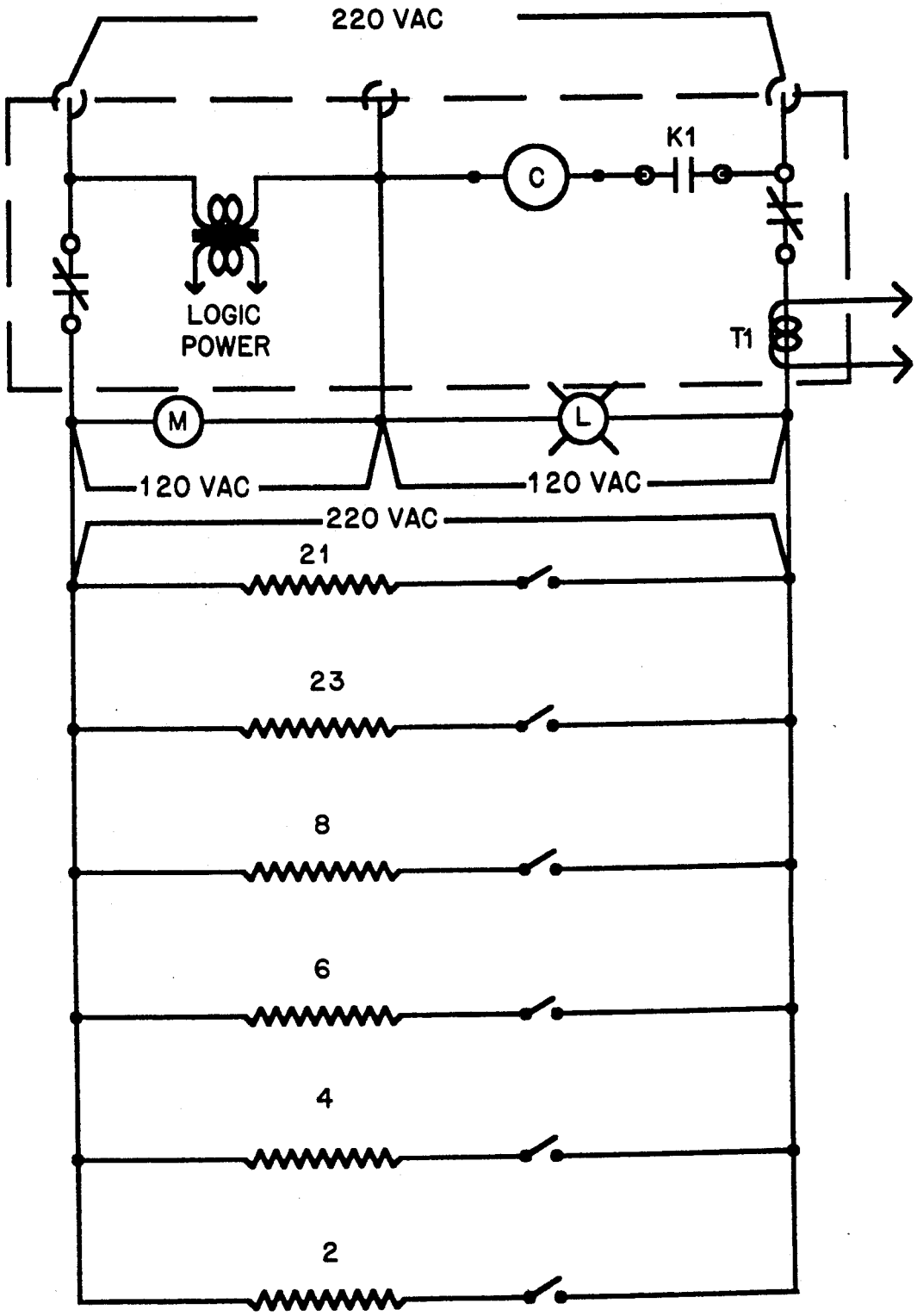
FIG. 2 of the drawings is a power diagram of the present invention in electrical communication with a standard range.
Figure 2:
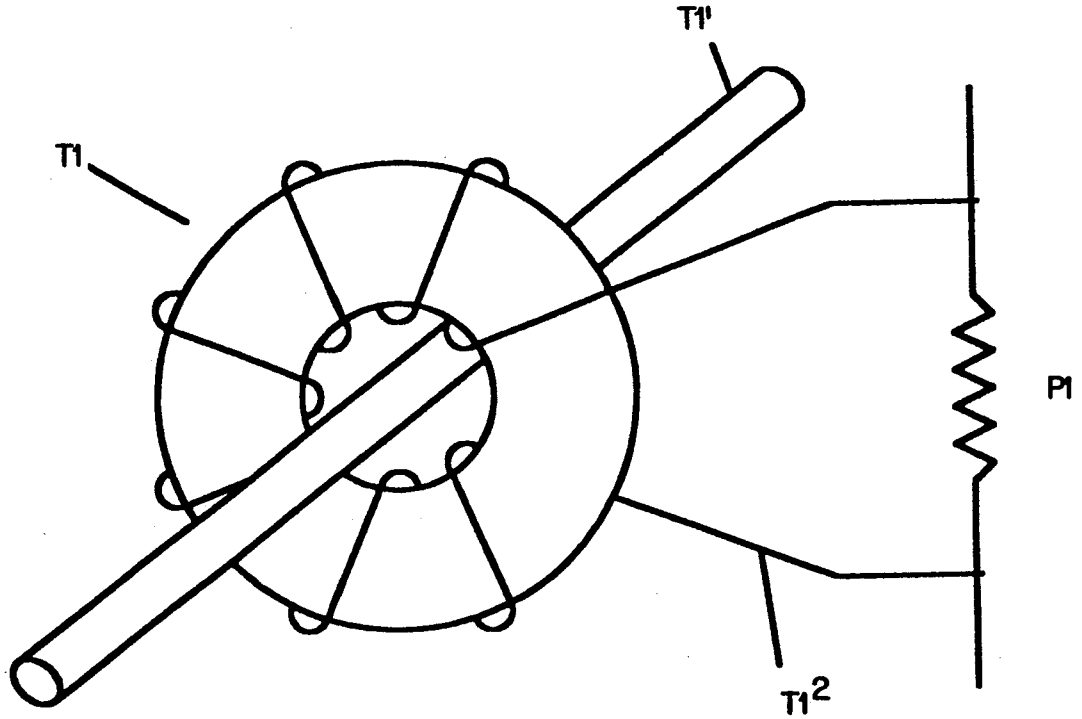

FIG. 2 is a power diagram of the range monitoring apparatus in electrical communication with standard range elements including burners 2, 4, 6 and 8, and oven elements 21 and 23.

Typically, burners 2, 4, 6 and 8 and oven element 21, a broiler element, illustrated in the power diagram of FIG. 2, are similarly controlled by the present invention. Oven element 23, a baking element, however, is thermostatically controlled. Accordingly, a high temperature alert (S2) and a smoke alert (LED1 and Q4) are provided, as seen in FIG. 4.

While FIG. 1 illustrates the preferred embodiment of range monitoring apparatus 10, it is envisioned that range monitoring apparatus 10 can be built directly into range 18 such that no sensing device would need to be inserted between power line 22 and electrical receptacle 24.

CIRCUIT DESCRIPTION

Referring to FIG. 2', current sensing transformer T1 secondary ($T1^2$) produces a small millivolt potential across variable resistor P1. T1 primary ($T^1$), best seen in FIG. 2', comprises a single conductor passing through T1 secondary, which is a doughnut-shaped core.

Figure 3:
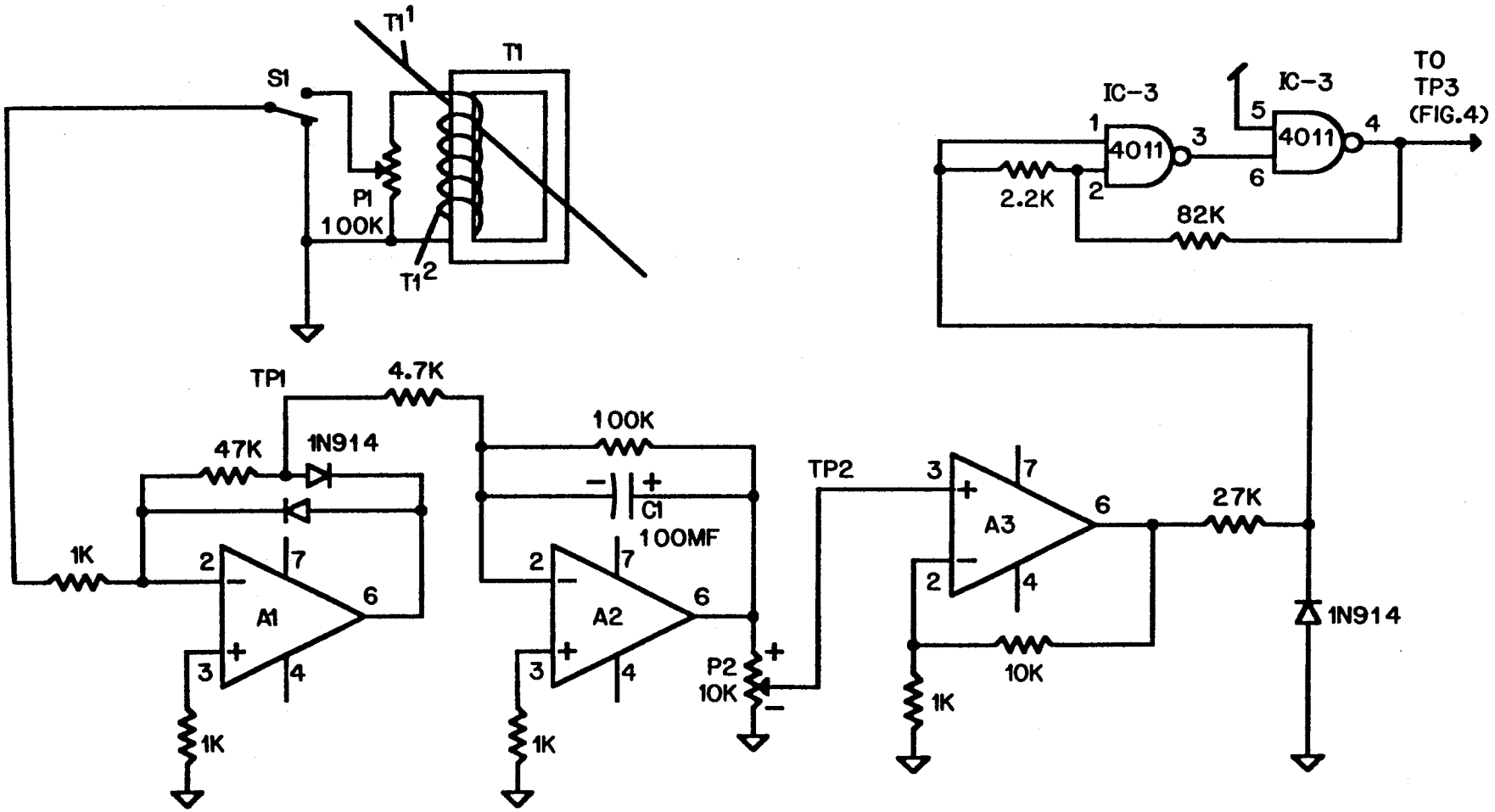
FIG. 3 of the drawings is a partial logic diagram of the circuitry of the range monitoring apparatus according to this invention.
Figure 4:
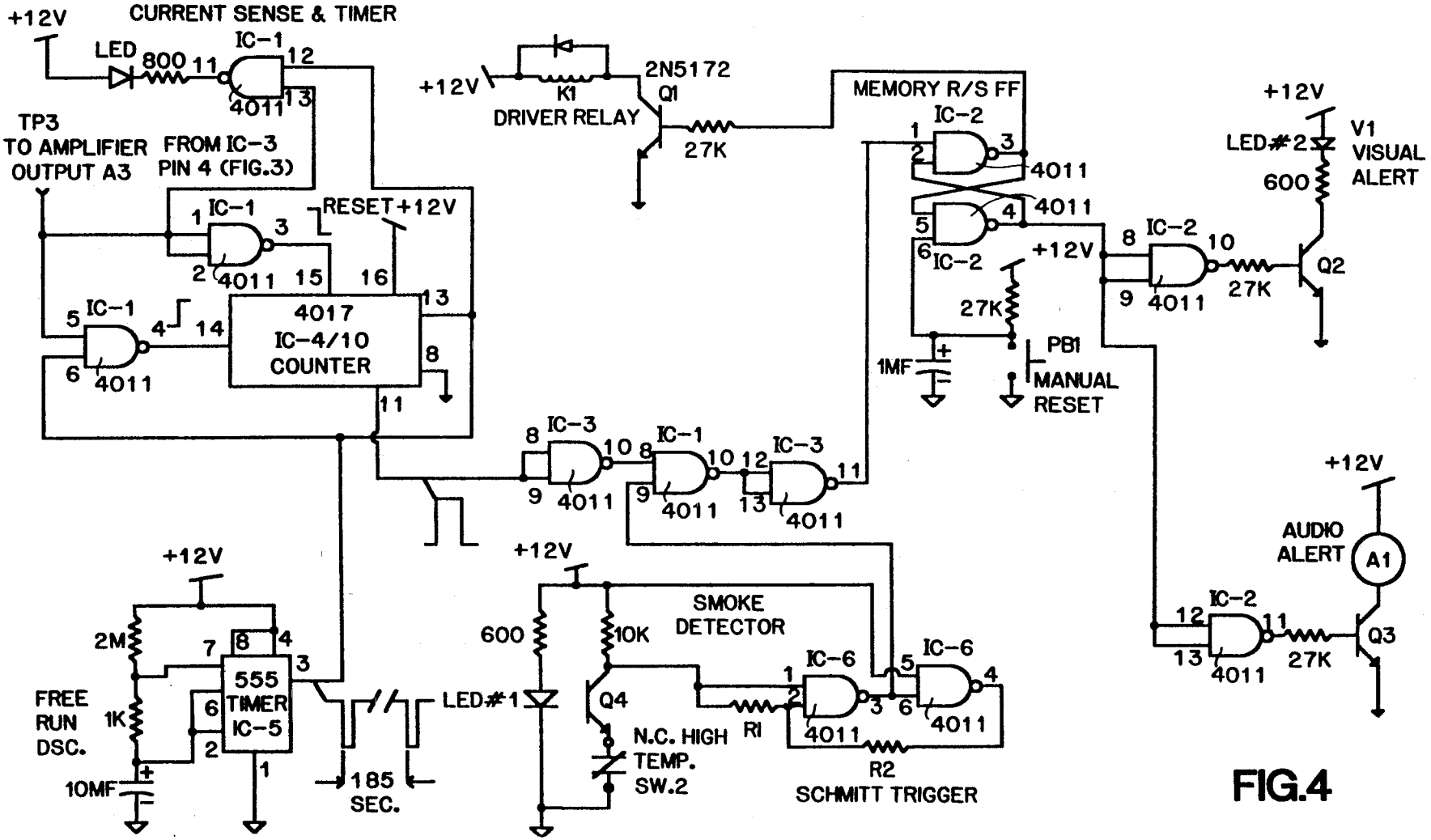
FIG. 4 of the drawings is a partial logic diagram of the circuitry of the range monitoring apparatus according to this invention.

Referring to FIGS. 3 and 4, op-Amp A1 converts A.C. millivolt signal from P1 wiper to half-wave D.C. signal shown at TP1. Amplifier A2 integrates input signal at TP1 producing a slow rising positive going voltage at TP2.

| TYPICAL RANGE BURNER ON/OFF TIMES | | |
|---|---|---|
| | ON | OFF |
| Warm | 3 sec. | 1 min. |
| Low | 2 sec. | 15–20 sec. |
| Medium | 4 sec. | 10–15 sec. |
| Med. High | 5 sec. | 7–8 sec. |
| Med. High | 10–15 sec. | 2–5 sec. |
| High | On Continuous | |

The above table shows typical ON times vs. OFF times for a standard range burner with different settings. The table shows a cyclic on/off patterns. Also, the table shows an increase in off time from high to warm setting. All the on/off modulation occurs in (1) minutes or less.

Figure 5:
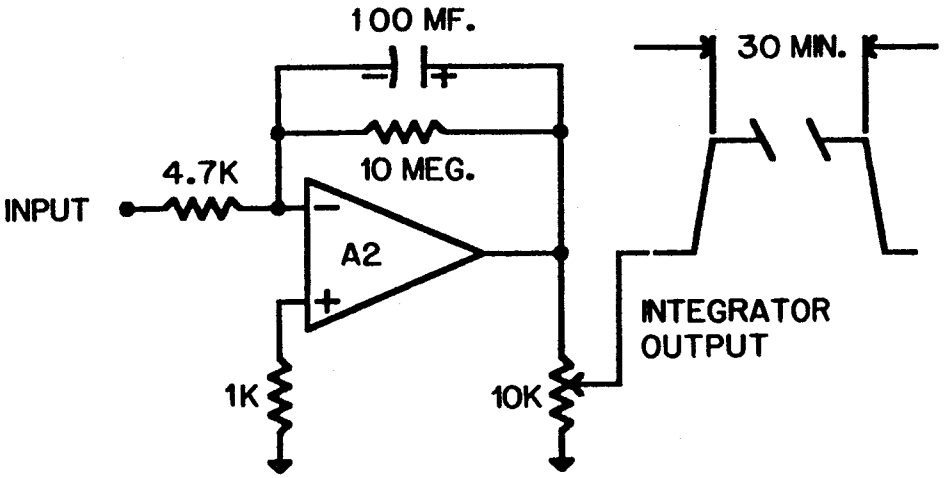
FIG. 5 of the drawings is a partial logic diagram of a portion of the circuitry of the range monitoring apparatus according to this invention.

Referring to FIGS. 3, 4 and particularly FIG. 5, which is an isolated portion of FIG. 3, the range thermostat modulates the current flow through the burner resulting in a fluctuating input signal to integrator (A2) via (A1). This thermostatic modulation causes the counter to be reset every time (A3), fed by (A2), falls below the Schmitt trigger threshold voltage level. The frequent resetting of the counter creates a serious problem. The counter never reaches its predetermined count. Therefore, it never produces the alarm condition. The solution is to stop the cyclic on/off transitions appearing at the counter. Normal range switch transitions caused by on/off range switch settings are necessary in order to arm the 4017 counter to begin the count. However, the random cyclic transitions need to be filtered out before they cause the counter to be prematurely reset with their frequent appearance.

The integrator (−) slope is the solution. Integrator (12) output is composed of a dual slope wave shape. The main purpose for the integrator is to provide a time delayed slope for the (1) minute delay caused by the range thermostat. The (+) or up slope occurs when a burner is switched on and allows counter 4017 IC-4 to become armed via (A3), Schmitt trigger IC-3 and 4011 IC-1. This (+) up slope occurs very rapidly. The up slope takes approximately 2–3 seconds before it has sufficient amplitude to arm counter 4017 IC-4.

The (−) down slope is used to disarm the counter and occurs when a burner is switched off. The disarm slope time is determined by R2 and C1 time constant. The disarm (−) slope time takes approximately (1) minute. The integrator (−) slope provides the necessary time delay needed to insure that cyclic input modulation does not pass beyond the integrator. For all practical purposes the integrator filters out the modulations caused by the range burner thermostat. When the integrator functions properly it will allow the input signal to come and go without affecting the integrator output enough to reset the counter. This will provide the necessary signal immunity needed by the counter in order to prevent premature reset. However, due to the (1) minute time delay caused by the integrator, any genuine signal lasting more than (1) minute will be acknowledged. The genuine signal will rightly terminate the count without causing a subsequent alarm.

When P2 wiper voltage rises sufficient to allow A3 output to exceed Schmitt Trigger threshold, then Schmitt Trigger snap action output TP3 (FIG. 3) will enable IC-4 counter pin 14 (VIA IC-1 pins 5 and 4) and reset IC-4 pin-15 at the same time. IC-1 pin-5="1". IC-1 pin-6="1" except for "0" excursions every timing cycle produced by 555 IC-5 timer PIN-3.

Upon low excursion of IC-5, pin -3 counter IC-4 will increment one count and also disable clock inhibit pin -13 (IC-4) at the same time. After a preselected number of counter increments IC-4 pin-11 will go high setting memory RS flip-flop IC-2 pin -3 (via IC-1 PINS 8, 9, and 10). Memory flip-flop IC-2 will energize relay K1. K1 normally open contacts will close energizing contactor C breaking 220 vac power supply to range and resetting counter IC-4 via lack of (TI primary current supply) but not breaking power source to logic and control circuit. Setting memory RS flip-flop will also activate visual and audio alert devices through IC-2 pins -10 and 11. The cycle will repeat when manual reset push button PB1 is pressed. This description assumes one or more burners 20 and 21 of range 18 to be energized.

Logic power is derived from the unswitched side of the line voltage (FIG. 2).

This circuit will allow for a small standby current to flow through range 18 for items on range 18 requiring only small current such as a clock motor, oven lights, and front panel lights without activating the counter circuit. The allowable standby current can be compensated for by adjusting P1. Therefore, any reasonable amount of standby current can be allowed to pass through T1 without arming the counter circuit.

Still referring to FIG. 4, LED1 provides a constant light source for photodetector transistor Q4. Q4 is normally saturated with LED1 light beam present. Q4 collector provides a low voltage to Schmitt Trigger input PINS 1 and 2 IC-6 when in a saturated state. PIN 3 of IC-6 is normally HIGH="1" when phototransistor Q4 is saturated. If LED1 light source is interrupted by dense smoke, Q4 collector voltage will rise. When Q4 collector voltage crosses Schmitt trigger turn-on threshold voltage, IC-6 PIN 3 will go to Logic "0". A logic "0" present on either PIN 8 or 9 of IC-1 will cause memory RS flip-flop IC-2 to set. Schmitt trigger turn-on voltage is determined by resistor ratio R1/R2. When memory RS flip-flop is set IC-2 PIN 3="1", $Q_1$, $Q_2$, and $Q_3$ will turn on and activate respectively K1 relay, LED2 visual alert V1 and audio alert (A1). A second alarm path described below will also set memory R/S flip-flop IC-2. A high temperature condition will open normally closed high temperature switch (S2) contacts. When this happens, a fast rising voltage will appear on PINS 1 and 2 of IC-causing IC-6 PIN 3 to go low="0". A logic "0" on PIN 9 of IC-1 will cause the memory R/S flip-flop IC-2 to set. Manual rese PB1 will initialize the system for recycle when ready.

With regard to the integrator circuit function, it provides the necessary basic requirements for time delay and control of incoming modulating signals. It should be understood that the integrator function should not be limited to one means of design and control. A variety of control circuits could be used to do the job of control and delay.

In one embodiment, a computer could be used. Most modern day electric range type stoves could have a microprocessor based control system as part of their existing production design. A microcomputer control system can provide adequate computing and control signals to carry out the necessary digital filtration technique required to implement a software filter. A software filter would lend itself to easy parameter changes. It would also allow complete filtration control over all incoming modulation. This would be the preferred way to control the range if it already has a microprocessor embedded in the system.

Figure 6:
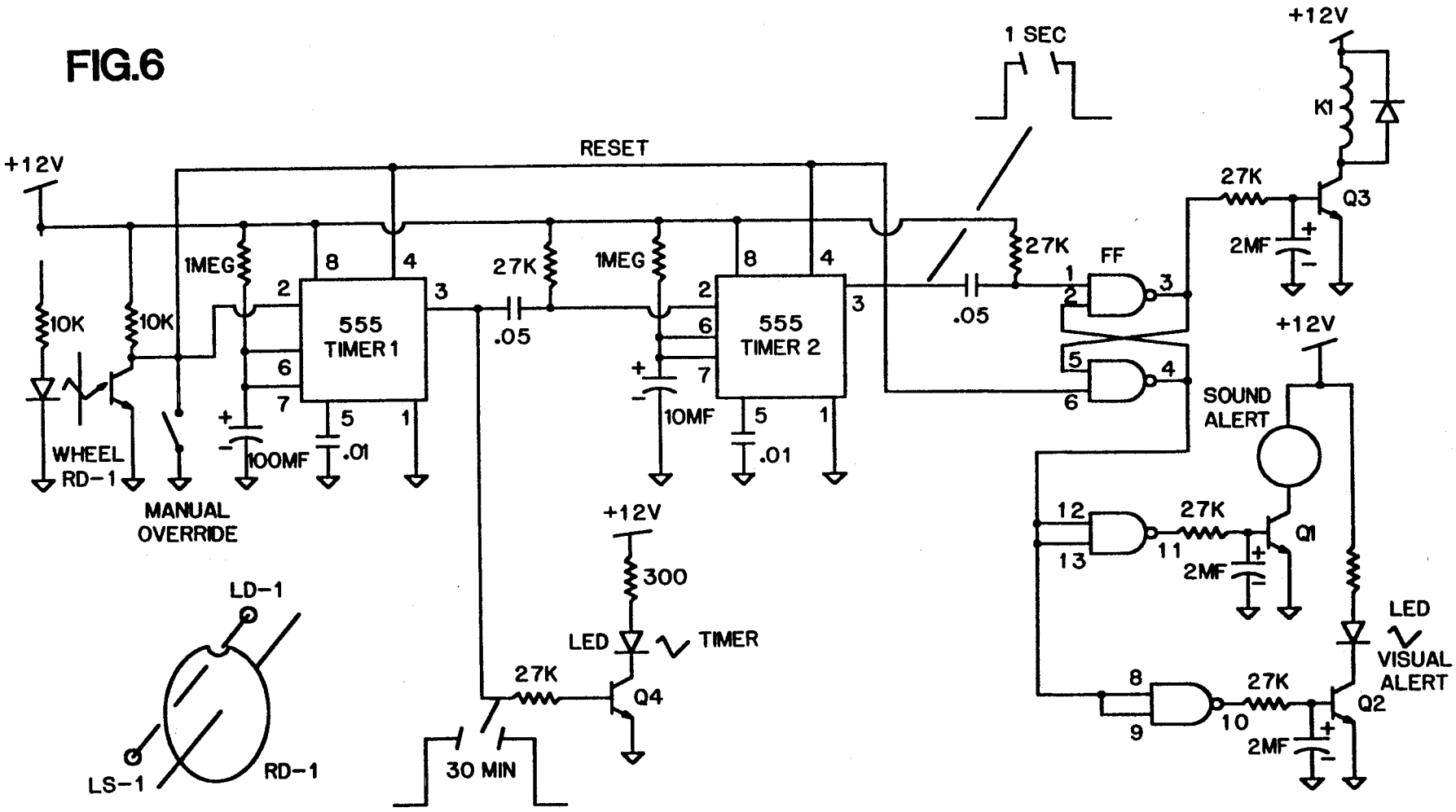
FIG. 6 of the drawings is a partial logic diagram of a range fire protection feature according to this invention.

It is apparent that a timing scheme not related to range current flow could be used as a range fire protection automatic switch. The schematic described in FIG. 6 illustrates such a design.

It should also be understood that the above timing function is limited only by the imagination of the designer. This circuit function lends itself to various possibilities when one explores the different ways this could be designed.

The basic idea is best described with a single word - TIME-as opposed to current versus time. Rotor disc RD-1 has a single hole positioned between a light source LS-1 and a light detector LD-1. When the hole is moved and the rotor is allowed to cut across the light beam in such a way as to interrupt the light path striking the detector LD-1, a signal is initiated on PIN-2 of Timer No. 1. This signal on PIN-2 of Timer No. 1 causes a timing signal to appear on PIN-3 of Timer No. 1. This timing signal on PIN-3 will last approximately (30) minutes. When it terminates, it will produce a short (1) second timing pulse on PIN-3 of Timer No. 2 When the short (1) second pulse terminates, it in turn produces a latch condition on Pins 3 and 4 of FF No. 1. The latch signal present on PIN-3 of FF No. 1, energizes relay K1 which in turn interrupts the main power to the range and terminates the timing cycle.

The latch signal appearing on PIN-4 of FF no. 1 will in turn activate Q1 and Q2 simultaneously. Q1 sounds the audio alarm; Q2 illuminates LED No. 1. K1, Q1, and Q2 are the alarm elements. These alarms can be acknowledged by manually returning rotor RD-1 back to its home position. If the rotor RD-1 is returned to its home position before Timer No. 1 and Timer No. 2 time-out, there will be no alarm.

A snap action mechanical rotor movement will provide the needed conditions to allow Timer No. 1 to begin without breaking into electronic oscillation. The snap action is a small inherent mechanical resistance purposely designed into the rotor RD-1. The manual dial resistance threshold must be overcome before rotor RD-1 has sufficient index displacement to interrupt the light path. This mechanical index safety margin will insure a positive clean start signal. Under no circumstances should the rotor RD-1 hole be allowed to partially interrupt the light beam. This condition would cause the unwanted oscillations. It should be understood that the home switch position will reset both Timers No. 1 and No. 2 as well as acknowledge the two alarm signals. It should also be understood that a clean break-away from the home position is required to initiate the timer signal.

It is thus seen that the present invention provides a novel apparatus for monitoring a range. It is also seen that the present invention provides such a novel range monitoring apparatus which can automatically disconnect power to the range if the range is left on for a predetermined amount of time at or in excess of a predetermined power level. It is further seen that such a novel range monitoring apparatus can disconnect power to the range if smoke or a high temperature is detected within the range. It is still further seen that the present invention provides such a novel range monitoring apparatus which signals to indicate when power to the range has been disconnected. Many variations are apparent to those of skill in the art, and such variations are embodied within the spirit and scope of the present invention as measured by the following appended claims.

That which is claimed is:

1. In combination with a standard range having burners thereon, oven elements therein, and a power line connected thereto, an apparatus in electrical communication therewith for monitoring said range comprising:
   - sensing means for sensing a preset level of electrical current through said power line;
   - timing means for timing said current;
   - whereby said sensing means initiates said timing means when said sensing means senses said preset level of electrical current;
   - disconnect means for interrupting said current;
   - signaling means providing a signal when said disconnect means interrupts said current, whereby said signal means is activated by said disconnect means;
   - electronic control means for controlling said timing means and said signaling means whereby said timing means can be adjusted to time for different predetermined amounts of time.

2. The apparatus according to claim 1 wherein said signaling means and said electronic control means are in a housing separate from, but in electrical communication with, said sensing means, said timing means and said disconnect means.

3. The apparatus according to claim 1 wherein said signaling means comprises an alarm and a light.

4. The apparatus according to claim 1 wherein said apparatus plugs directly into a female electrical receptacle and wherein said power line of said range plugs directly into said apparatus.

5. The apparatus according to claim 2 wherein said electronic control means includes a reset button and an override switch.

6. The apparatus according to claim 1 wherein said disconnect means is automatically activated when said sensing means and said timing means sense and time a predetermined current for a predetermined time.

7. The apparatus according to claim 1 further comprising means for detecting high temperature within said range and means for detecting smoke within said range.

8. The apparatus according to claim 1 further comprising acknowledging means for providing a reset signal for continued operation after said current has been interrupted.

* * * * *